United States Patent [19]

Davis, Jr.

[11] 4,050,334

[45] Sept. 27, 1977

[54] ZEE WRENCH

[75] Inventor: Robert Davis, Jr., Nashville, Tenn.

[73] Assignee: The Raymond Lee Organization, Inc., New York, N.Y.

[21] Appl. No.: 685,711

[22] Filed: May 12, 1976

[51] Int. Cl.[2] ..... B25B 13/48

[52] U.S. Cl. ..... 81/119; 81/3 R

[58] Field of Search ..... 81/1 R, 3 R, 53 R, 71, 81/90 R, 119; 145/50 DB; 254/25

[56] References Cited

U.S. PATENT DOCUMENTS 3,134,574 5/1964 Reuterfors ..... 254/25

FOREIGN PATENT DOCUMENTS 7,345 of 1910 United Kingdom ..... 254/25

*Primary Examiner*—James L. Jones, Jr.

*Assistant Examiner*—James G. Smith

*Attorney, Agent, or Firm*—Howard I. Podell

[57] ABSTRACT

A wrench adaptable for freeing the jammed rotor of a sink garbage disposal unit. The wrench is in the form of a shaped solid bar formed with a straight shaft section the handle end of which is bent at an acute angle to the axis of the shaft section, with the opposed tool end of the bar bent in the plane of the handle section to lie perpendicular to the axis of the shaft section. The tool end of the bar is formed as a rectangular shaped section of a size to fit about upraised detents or cutting blades on the rotor of the garbage disposal unit so as to rock and free the rotor, when jammed, and the tool is of a size to fit into the drain outlet of the sink to which the disposal unit is attached and to extend beyond the drain, when installed.

1 Claim, 3 Drawing Figures

ZEE WRENCH

SUMMARY OF THE INVENTION

My invention is a wrench adaptable for freeing the jammed rotor of a sink garbage disposal unit. The wrench is in the form of a shaped solid bar formed with a straight shaft section the handle end of which is bent at an acute angle to the axis of the shaft section, with the opposed tool end of the bar bent in the plane of the handle section to lie perpendicular to the axis of the shaft section. The tool end of the bar is formed as a rectangular shaped section of a size to fit about upraised detents or cutting blades on the rotor of the garbage disposal unit so as to rock and free the rotor, when jammed, and the tool is of a size to fit into the drain outlet of the sink to which the disposal unit is attached and to extend beyond the drain, when installed.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
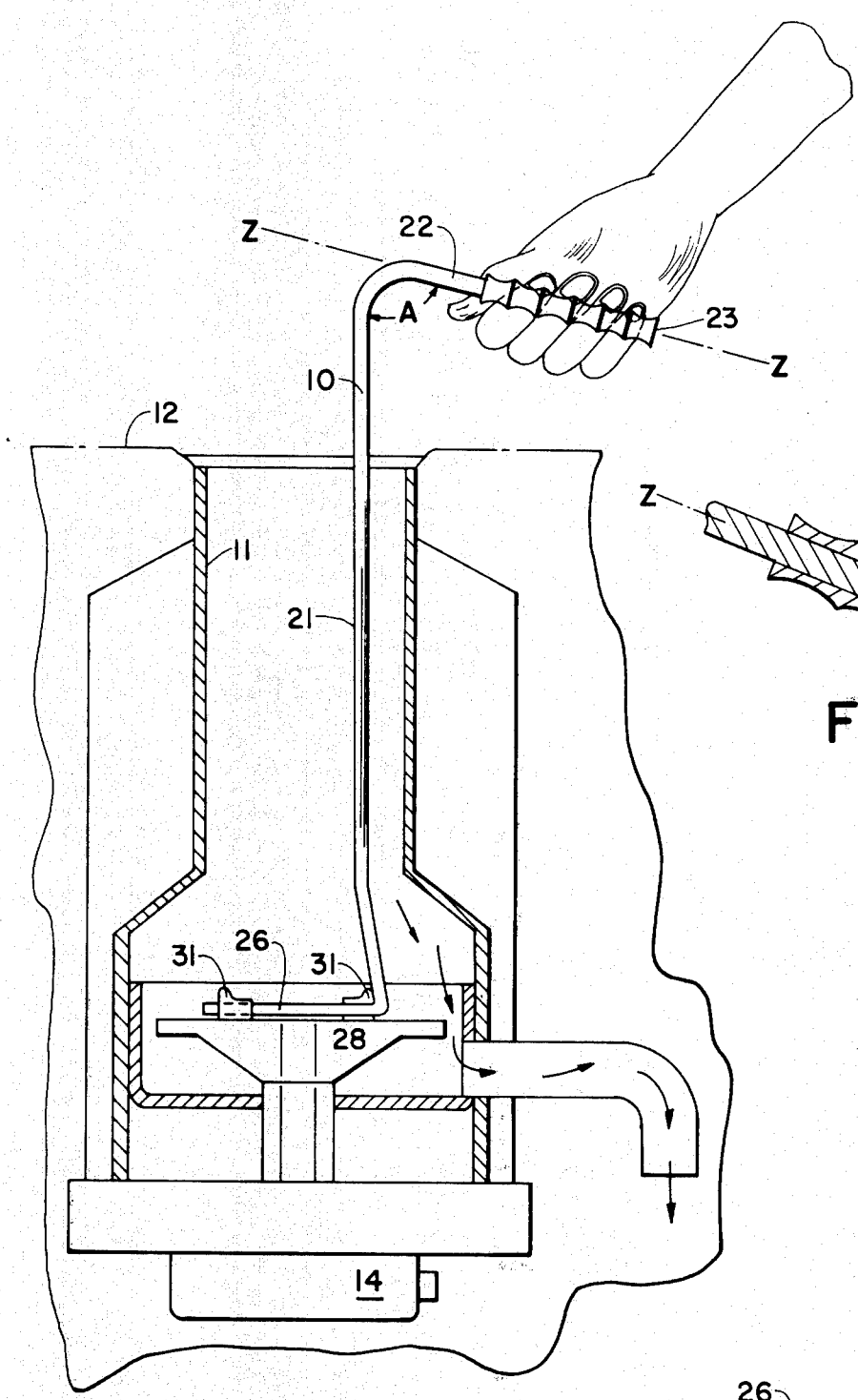
FIG. 1 is an elevation view of the invention in use.
Figure 2:
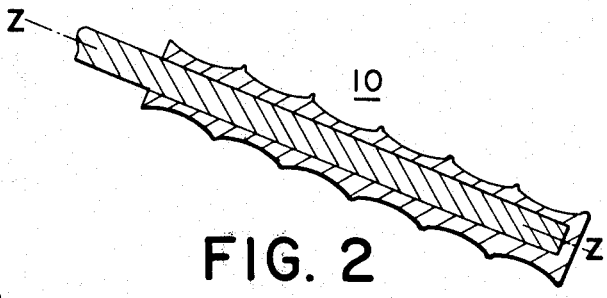
FIG. 2 is a detail sectional view of the handle end of the invention.
Figure 3:
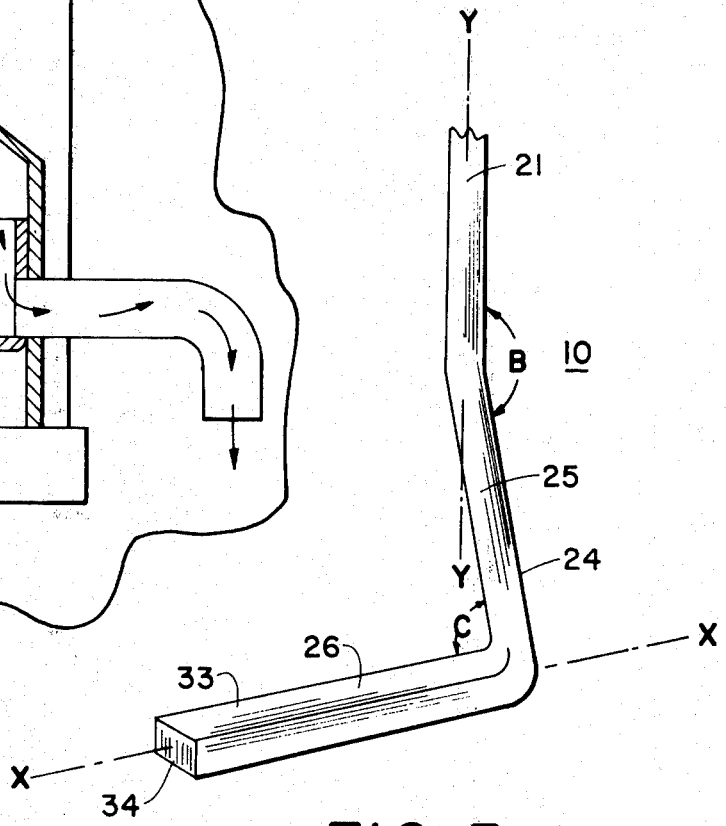
FIG. 3 is a detail view of the tool end of the invention.

Turning now descriptively to the drawings, in which similar reference characters denote similar elements throughout the several views, FIGS. 1–3 illustrate the Z Wrench 10 which may be inserted into the open drain pipe 11 of a sink 12 to free a jammed rotor 28 of a garbage disposal unit 14 fitted in drain pipe 12.

The wrench 10 is formed of a straight shaft section 21, bent at a first end at an acute angle A to form a handle section 22 fitted with a handle grip 23, and bent at the opposed shaft end at an obtuse angle B to form the tool section 24. Tool section 24 is formed of a first straight length 25 joined by an acute angle C to a straight jaw member 26, with jaw member 26 extending along an axis X—X perpendicular to shaft axis Y-Y, in a direction to intersect the Y—Y axis of shaft section 21.

Jaw member 26 is of a length to fit within drain pipe 11 and extend in the seated position, on top of rotor 28 of the disposal unit 14 so as to contact the upraised mount detents 31 of the cutting blades of the rotor 28, with shaft section 21 of a length to extend beyond drain pipe 11 in the seated position of the tool.

The axis Z—Z of handle section 22 lies preferably in a common plane of axis X—X of jaw member 26 to indicate the position of jaw member 26 when installed in the drain pipe 11.

Length 25 of tool section 24 is oriented at an angle B away from the vertical axis of the drain pipe in the installed position to enable jaw member 26 to extend across top face 13 to grip the sides of both opposed detent mounts 13. Jaw member 26 is preferably shaped in section with flat opposed sides 33, both perpendicular to a flat bottom 34.

In use, the handle and jaw sections when seated on rotor 28 are sharply rotated, in reciprocal fashion to strike detent mounts 13 from alternate directions to rock a jammed rotor 28 so as to clear the jam.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tool for use in freeing the rotor of a garbage disposal unit installed in the drain of an attached sink comprising a shaft member joined at a first end to a handle section and at a second end to a jaw section, said jaw section of a size to fit within a drain pipe and to fit against upraised detents on the rotor of a garbage disposal unit installed in said drain pipe, said jaw section oriented to extend in a straight line and in a radial perpendicular direction to the axis of the shaft section, and at a perpendicular angle to the shaft axis, said handle section bent to extend in a radial direction and at an acute angle to the shaft section so as to extend from the shaft section towards the jaw section, said shaft section of a length to extend from the surface of the rotor to beyond the drain opening of the drain pipe, in which the jaw section is joined to the shaft section by a length of bar which extends away from the axis of the shaft section so that the attached jaw section intersects the axis of the shaft section.

* * * * *